US008240593B2

(12) United States Patent
Ito

(10) Patent No.: US 8,240,593 B2
(45) **Date of Patent: *Aug. 14, 2012**

(54) PAPER FEEDING DEVICE

(75) Inventor: Akihiko Ito, Chiba (JP)

(73) Assignee: Seiko Instruments Inc. (JP)

( * ) Notice: Subject to any disclaimer, the term of this patent is extended or adjusted under 35 U.S.C. 154(b) by 592 days.

This patent is subject to a terminal disclaimer.

(21) Appl. No.: 12/378,178

(22) Filed: Feb. 11, 2009

(65) Prior Publication Data

US 2009/0212086 A1 Aug. 27, 2009

(30) Foreign Application Priority Data

Feb. 22, 2008 (JP) ..... 2008-041228

(51) Int. Cl.
*B65H 43/00* (2006.01)

(52) U.S. Cl. ..... 242/563; 242/598.3

(58) Field of Classification Search ..... 242/563, 242/563.2, 594, 594.5, 598, 598.3, 598.5; 400/708

See application file for complete search history.

(56) References Cited

U.S. PATENT DOCUMENTS

| | | | | |
|---|---|---|---|---|
| 5,374,007 | A * | 12/1994 | Murison | 242/538.2 |
| 5,725,321 | A * | 3/1998 | Brannan et al. | 400/708 |
| 7,828,239 | B2 * | 11/2010 | Ito | 242/563 |
| 2009/0152793 | A1 * | 6/2009 | Ito | 271/8.1 |

FOREIGN PATENT DOCUMENTS

| | | | |
|---|---|---|---|
| EP | 1232872 | | 8/2002 |
| EP | 2093172 | A2 * | 8/2009 |
| JP | 2009143695 | A * | 7/2009 |
| WO | 2004113088 | | 12/2004 |
| WO | 2007033484 | | 3/2007 |

* cited by examiner

*Primary Examiner* — Michael R. Mansen
*Assistant Examiner* — Juan Campos, Jr.
(74) *Attorney, Agent, or Firm* — Adams & Wilks

(57) ABSTRACT

A paper feeding device that feeds a sheet of a paper roll to a printing device includes two spaced-apart side plates having opposed first notches for rotatably bearing-supporting a first paper roll and opposed second notches for rotatably bearing-supporting a second paper roll that may have a different diameter in an unused state from that of the first paper roll. A near end sensor for detecting the remaining amount of the paper rolls is slidably positioned in a linear groove formed in one of the side plates. The linear groove having a longitudinal axis that passes through a midpoint of a straight line connecting a rotation center of a first paper roll bearing-supported in the first notches and a rotation center of a second paper roll bearing-supported in the second notches. When first and second paper rolls of different sizes are used, if both paper rolls are wound on paper tubes of the same size, the position of the near end sensor need not be changed, which is a great convenience for the user.

11 Claims, 3 Drawing Sheets

PAPER FEEDING DEVICE

BACKGROUND OF THE INVENTION

1. Field of the Invention

The present invention relates to a paper feeding device that is used in a printer, which prints and issues a receipt, ticket, or the like using a sheet of a paper roll, and feeds the sheet of the paper roll to a printing device.

2. Description of the Related Art

As such a paper feeding device, for example, there is known a paper feeding device disclosed in Patent Document JP 05-345429 A.

However, in the paper feeding device disclosed in Patent Document JP 05-345429 A, a paper roll holder which bearing-supports the paper roll accommodates only one kind of paper roll, in other words, only, for example, a paper roll having 4 inches diameter in an unused (new) state. Thus, when a user intends to change to a paper roll having a larger diameter (paper roll having 6 inches diameter, for example) in response to usage condition or the like, the paper roll having the larger diameter cannot be mounted to the paper roll holder, thereby causing a problem of bad usability.

SUMMARY OF THE INVENTION

The present invention has been made in view of the above-mentioned circumstances, and therefore has an object to provide a paper feeding device in which a plurality of paper rolls having different diameters in an unused (new) state can be mounted freely according to a choice of a user, and can increase convenience for a user.

In order to solve the above-mentioned problem, the present invention adopts the following means.

A paper feeding device according to the present invention is a paper feeding device that feeds a sheet of a paper roll to a printing device and includes two side plates vertically arranged along both side surfaces of the paper roll, each of the side plates including a plurality of notches which are capable of bearing-supporting paper rolls having different diameters in an unused state, one of the side plates including: a near end sensor that detects a remaining amount of the paper roll; and a linear groove that causes the near end sensor to slide in two directions moving close to and away from the paper roll bearing-supported by each of the notches.

In the paper feeding device according to the present invention, there are provided the plurality of notches which are capable of bearing-supporting the paper rolls having the different diameters in the unused (new) state, and hence the paper rolls having the different diameters in the unused (new) state can be mounted freely according to a choice of a user, whereby it is possible to increase the convenience for a user.

Further, even in a state where the paper roll is bearing-supported by any notches, the near end sensor is caused to slide along the linear groove, whereby the near end sensor can be easily moved to a direction close to or a direction away from the paper roll and can be easily arranged in a position suitable for detecting the remaining amount of the paper roll.

In the paper feeding device, it is more suitable that the groove is formed so that a longitudinal axis of the groove passes through a midpoint of a straight line connecting a rotation center of a paper roll bearing-supported by one notch of the plurality of notches and a rotation center of a paper roll bearing-supported by another notch of the plurality of notches and is placed on another straight line which is vertical to the straight line.

According to the paper feeding device described above, in the case where a diameter of a paper tube which is set (fixed) to a center portion of the paper roll bearing-supported by the one notch and rotates together with the paper roll and a diameter of a paper tube which is set (fixed) to a center portion of the paper roll bearing-supported by the another notch and rotates together with the paper roll are equal (or substantially equal) to each other, a sensor portion of the near end sensor detects that a remaining amount of the paper roll set in the one notch and a remaining amount of the paper roll set in the another notch are equal (or substantially equal) to each other.

Therefore, even in the case where a paper roll having other diameter (different diameter) is set in the one notch or the another notch, when a remaining amount of a paper roll to be detected is not changed, the near end sensor can be left as it is without being caused to move, whereby it is possible to further increase the convenience for a user.

In the paper feeding device described above, it is more suitable that the groove is formed so that the near end sensor can be moved close to and away from a paper roll bearing-supported by a notch other than the one notch and the another notch.

According to the paper feeding device described above, the near end sensor can be moved close to and away from the paper roll bearing-supported by any notch, whereby it is possible to increase the convenience for a user.

A printer according to the present invention includes the paper feeding device which is capable of freely mounting the paper rolls having the different diameters in the unused (new) state according to the choice of a user, thereby increasing the convenience for a user.

According to the present invention, the plurality of the paper rolls having the different diameters in the unused (new) state can be mounted freely according to the choice of a user, thereby attaining an effect of increasing the convenience for a user.

DETAILED DESCRIPTION OF THE PREFERRED EMBODIMENT

Hereinafter, an embodiment of a paper feeding device according to the present invention is described with reference to FIGS. 1 to 3.

Figure 1:
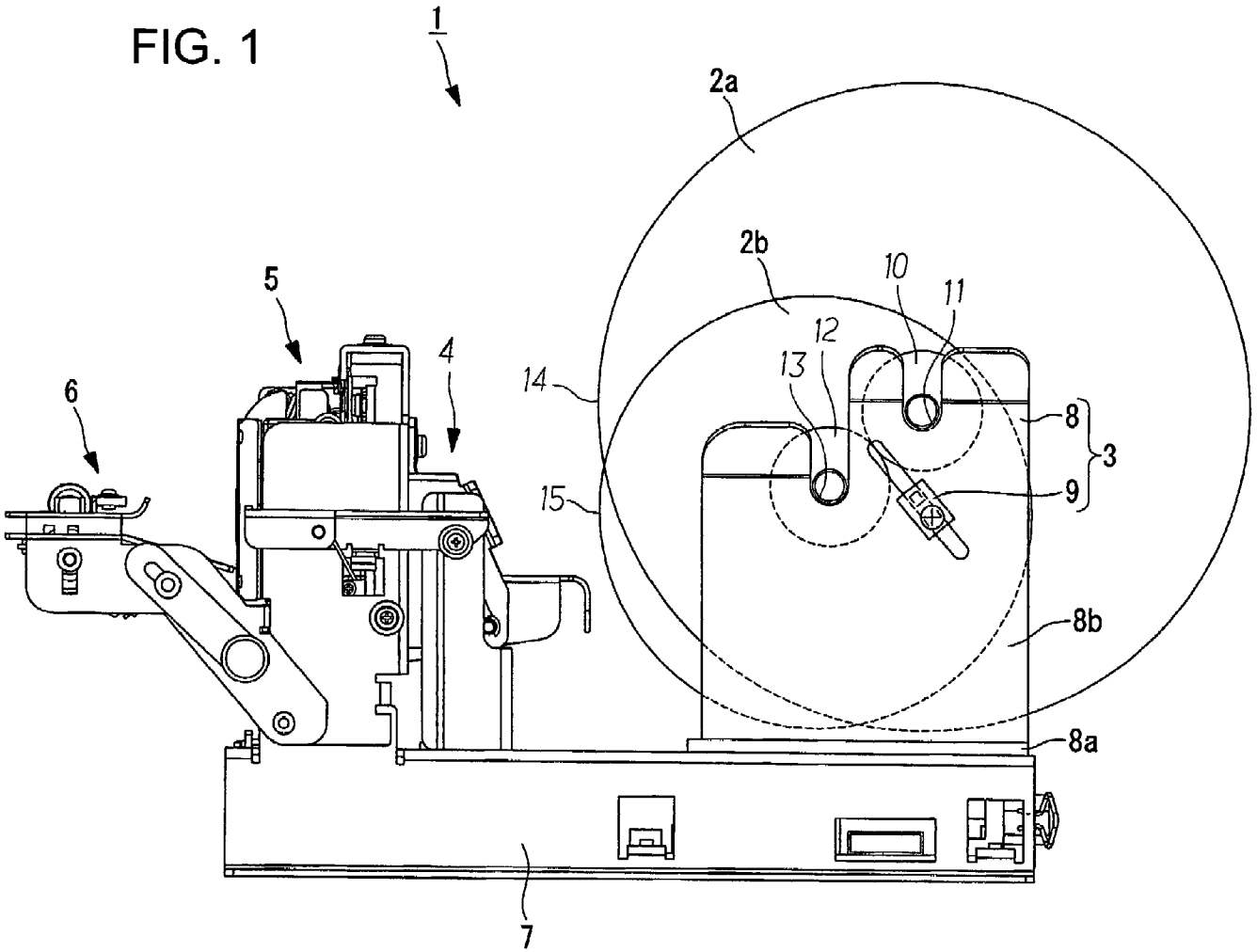
FIG. 1 is a side view of a printer provided with a paper feeding device according to an embodiment of the present invention.

FIG. 1 is a side view of a printer provided with the paper feeding device according to this embodiment. FIG. 2 is an enlarged view of one side plate of the paper feeding device illustrated in FIG. 1. FIG. 3 is a sectional view taken along an arrow A-A of FIG. 2.

As illustrated in FIG. 1, a printer 1 includes a printing device 4 that prints various kinds of information on a thermal printing layer of a sheet of a paper roll (thermal paper, for example) 2*a* (2*b*) fed from a paper feeding device 3 in a conveying direction of the sheet of the paper roll 2*a* (2*b*), a cutting device (paper cutting device) 5 that cuts the sheet of the paper roll 2*a* (2*b*) printed by the printing device 4, and a paper discharging device 6 that takes out (discharges) the sheet of the paper roll 2*a* (2*b*) cut by the cutting device 5 from a bezel (paper outlet) (not shown).

The printing device 4 is a so-called thermal printer, and includes a thermal head (not shown) for heating the thermal printing layer of the sheet of the paper roll 2*a* (2*b*) and a platen roller (not shown) pressed to the thermal head. The printing device 4 performs printing while pinching the sheet of the paper roll 2*a* (2*b*) fed from the paper feeding device 3 between the thermal head and the platen roller, and conveys the same.

The cutting device 5 includes, for example, a pair of disk-like rotating blades (not shown) for cutting the sheet of the paper roll 2*a* (2*b*) taken out from the printing device 4 to a desired length, and conveys the cut sheet of the paper roll 2*a* (2*b*) to the paper discharging device 6.

Further, the paper feeding device 3, the printing device 4, the cutting device 5, and the paper discharging device 6 are combined through a main body frame 7.

As illustrated in FIG. 1, the paper feeding device 3 according to this embodiment includes a paper holder 8 and a near end sensor 9.

The paper holder 8 includes a bottom plate 8*a* having a substantially rectangular shape in plan view extending in the conveying direction and a width direction of the sheet of the paper roll 2*a* (2*b*), and two side plates 8*b* extending upward in a vertical direction from side edges of the bottom plate 8*a*.

In each side plate 8*b* of the paper holder 8, there are provided, for example, a first notch 11 which is set (fixed) to a center portion of the paper roll 2*a* having 6 inches diameter and bearing-supports a paper tube (core: rotating shaft) 10 rotating together with the paper roll 2*a*, and, for example, a second notch 13 which is set (fixed) to a center portion of the paper roll 2*b* having 4 inches diameter and bearing-supports a paper tube (core: rotating shaft) 12 rotating together with the paper roll 2*b*. The first notch 11 and the second notch 13 are formed so that a front end (end portion on the printing device 4 side) 14 of an outer peripheral surface of the unused (new) paper roll 2*a* having 6 inches diameter when the paper roll 2*a* is set in the first notch 11 through the paper tube 10, and a front end (end portion on the printing device 4 side) 15 of an outer peripheral surface of the unused (new) paper roll 2*b* having 4 inches diameter when the paper roll 2*b* is set in the second notch 13 through the paper tube 12 are positioned in the same vertical plane.

Further, a groove 16 is provided in one side plate 8*b* of the paper holder 8 (near-side side plate 8*b* of FIG. 1, in this embodiment) The groove 16 guides protrusions 9*a* (see FIG. 3) protruding from a back surface of the near end sensor 9 (inner-side surface of FIG. 1) and serves as an opening which is required for a sensor portion 9*b* arranged on the back surface of the near end sensor 9 to detect a remaining amount of the paper roll 2*a* (2*b*).

Figure 2:
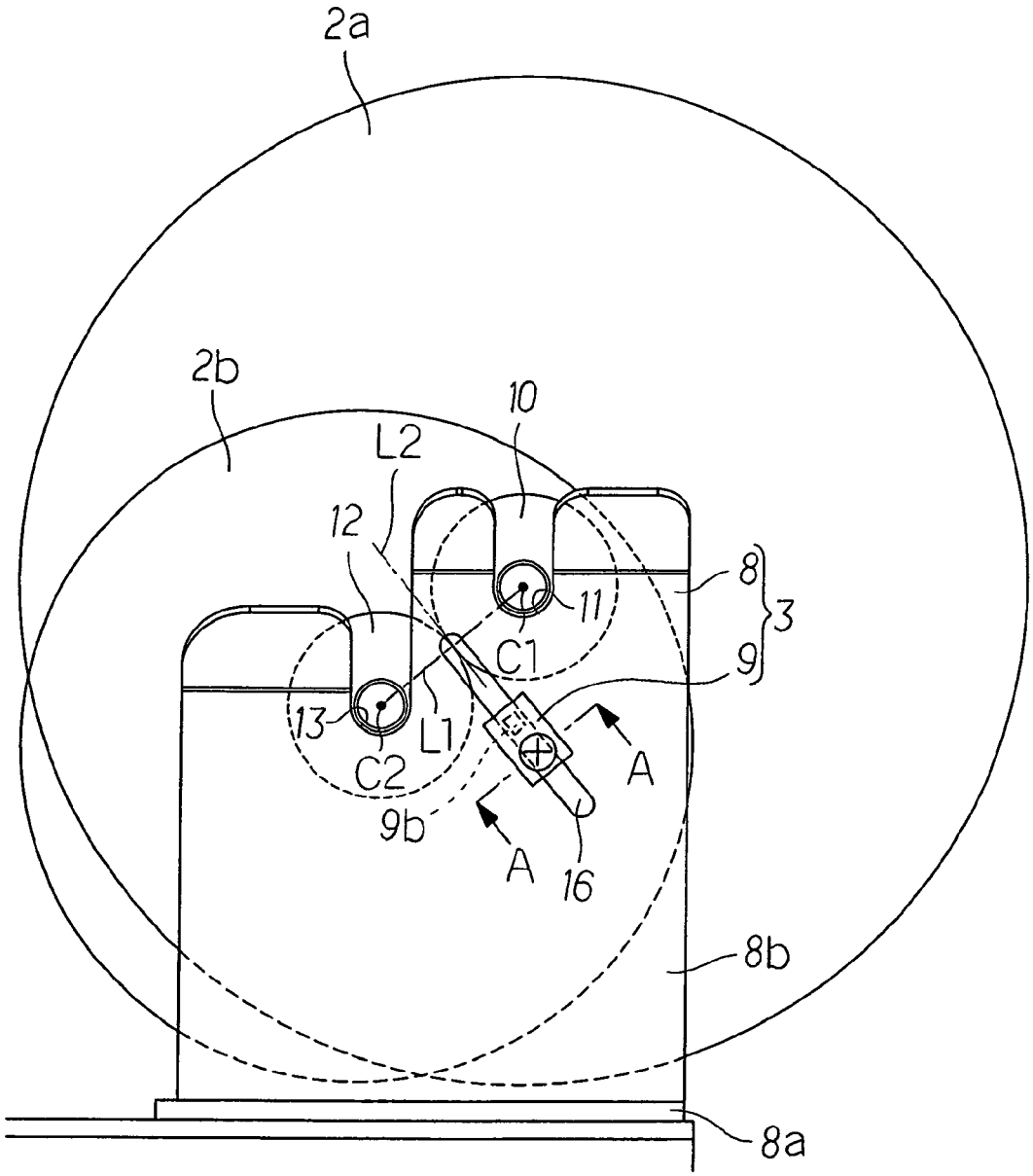
FIG. 2 is an enlarged view of one side plate of the paper feeding device illustrated in FIG. 1.

As illustrated in FIG. 2, the groove 16 is a long hole which is formed so that a central axis (longitudinal axis) thereof passes through a midpoint of a straight line L1 connecting a central axis (rotation center) C1 of the paper tube 10 and a central axis (rotation center) C2 of the paper tube 12 and is placed on a straight line (vertical bisector) L2 which is vertical to the straight line L1. In other words, the groove 16 is formed so that a distance between the sensor portion 9*b* of the near end sensor 9 and the central axis C1 of the paper tube 10 when the near end sensor 9 is moved closest to the paper tube 10 set in the first notch 11, and a distance between the sensor portion 9*b* of the near end sensor 9 and the central axis C2 of the paper tube 12 when the near end sensor 9 is moved closest to the paper tube 12 set in the second notch 13 are equal to each other, and that the distance between the sensor portion 9*b* of the near end sensor 9 and the central axis C1 of the paper tube 10 when the near end sensor 9 is moved farthest away from the paper tube 10 set in the first notch 11 and the distance between the sensor portion 9*b* of the near end sensor 9 and the central axis C2 of the paper tube 12 when the near end sensor 9 is moved farthest away from the paper tube 12 set in the second notch 13 are equal to each other.

Figure 3:
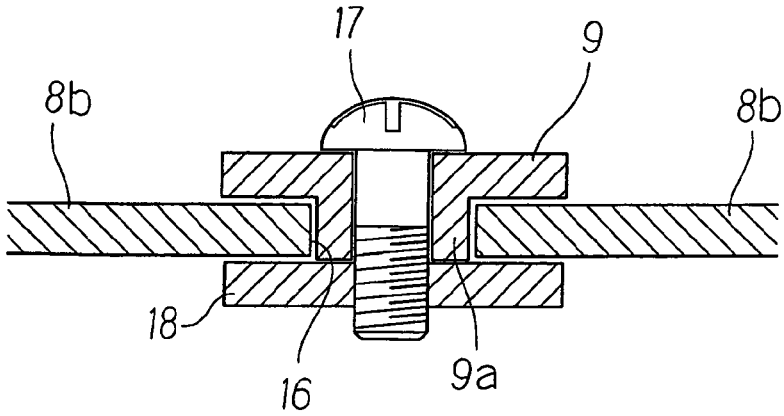
FIG. 3 is a sectional view taken along an arrow A-A of FIG. 2.

As illustrated in FIG. 3, the protrusions 9*a* protruding from the back surface of the near end sensor 9 are formed to be fitted into the groove 16 so as not to generate backlash therewithin, and formed to move smoothly without drag from one end of the groove 16 to the other end thereof.

Further, in the near end sensor 9, a screw 17 is loosened to generate clearances (gaps) between end surfaces of the protrusions 9*a* and a surface of a presser plate 18, whereby the near end sensor 9 can be caused to slide integrally with the screw 17 and the presser plate 18 while keeping that condition along the groove 16 to a desired position. At the same time, the screw 17 is fastened at a desired position to sandwich the one side plate 8*b* between the end surfaces of the protrusions 9*a* and the surface of the presser plate 18, whereby the near end sensor 9 can be set (fixed) to a desired position.

In the paper feeding device 3 according to this embodiment, the first notch 11 and the second notch 13 are provided on each side plate 8*b* of the paper holder 8, and hence any one of the two paper rolls 2*a*, 2*b* having the different diameters in the unused (new) state is mounted freely according to a choice of a user, whereby it is possible to increase the convenience for a user.

Further, when the paper roll 2*a* having 6 inches diameter or the paper roll 2*b* having 4 inches diameter in the unused state is mounted to the first notch 11 or the second notch 13, the first notch 11 and the second notch 13 are formed so that the front ends 14, 15 of the outer peripheral surfaces of the paper rolls 2*a*, 2*b* are positioned in the same vertical plane, whereby it is possible to stably feed a paper sheet to the printing device 4 in the case of using any one of the paper rolls 2*a*, 2*b*.

Moreover, in the paper feeding device 3 according to this embodiment, the groove 16 forming of a long hole is provided in the one side plate 8*b* of the paper holder 8. Accordingly, a user can set the near end sensor 9 to a desired position easily and rapidly in accordance with the diameter of the paper roll 2*a* (2*b*) selected appropriately as needed.

Note that, adjusting the position of the near end sensor 9 can be performed by merely sliding along the groove 16, and hence anyone can perform it easily.

Still further, in the paper feeding device 3 according to this embodiment, the groove 16 is formed so that the central axis thereof passes through the midpoint of the straight line L1 connecting the central axis C1 of the paper tube 10 and the central axis C2 of the paper tube 12 and is placed on the straight line L2 which is vertical to the straight line L1. Accordingly, in the case where the diameter of the paper tube 10 and the diameter of the paper tube 12 are equal (or substantially equal) to each other, the sensor portion 9*b* of the near end sensor 9 detects that the remaining amount of the paper roll 2*a* set in the first notch 11 and the remaining amount of the paper roll 2*b* set in the second notch 13 are equal (or substantially equal) to each other.

Therefore, even in the case where the paper roll 2*b* or a paper roll having a diameter other than that of the paper rolls 2*a*, 2*b* is set in the first notch 11, or a paper roll having a diameter other than that of the paper rolls 2*a*, 2*b* is set in the second notch 13, when a remaining amount of the paper roll to be detected is not changed, the near end sensor 9 can be left as it is without being caused to move, whereby it is possible to further increase the convenience for a user.

On the other hand, a manufacturer which manufactures and sells the paper feeding device 3 does not need to prepare paper holders corresponding to respective paper rolls having the different diameters in the unused (new) state, and hence the number of components can be reduced. Further, it is possible to reduce the manufacturing cost and to realize the simplification of parts control.

Further, the printer 1 provided with the paper feeding device 3 according to the present invention includes the paper feeding device 3 which can mount the paper rolls 2*a*, 2*b* having the different diameters in the unused (new) state freely according to the choice of a user, whereby it is possible to increase the convenience for a user.

Note that, the present invention is not limited to the embodiment described above, and variation or modification can be effected appropriately as needed without departing from the technical idea of the present invention.

For example, in the embodiment described above, the paper holder 8 provided with the two notches 11, 13 has been described. However, the present invention is not limited thereto and can employ a paper holder 25 provided with three notches 21, 22, 23 and a circular hole (notch) 24 as illustrated in FIG. 4.

The notches 21, 22, 23 and the circular hole 24 are each provided in each of the side plates 8*b* of the paper holder 8 and bearing-support paper tubes 26, 27, 28, 29 which are set to center portions of paper rolls (not shown) and rotate together with the paper rolls. The notches 21, 22, 23 and the circular hole 24 are formed so that a straight line L3 connecting a central axis (rotation center) C3 of the paper tube 26 and a central axis (rotation center) C4 of the paper tube 29 passes through a midpoint of a straight line L4 connecting a central axis (rotation center) C5 of the paper tube 27 and a central axis (rotation center) C6 of the paper tube 28 and is placed on straight line (vertical bisector) which is vertical to the straight line L4.

Further, a groove 30 is provided in the one side plate 8*b* of the paper holder 8. The groove 30 guides the protrusions 9*a* (see FIG. 3) protruding from the back surface of the near end sensor 9 (see FIGS. 1 and 2) and serves as an opening which is required for the sensor portion 9*b* (see FIG. 2) arranged on the back surface of the near end sensor 9 to detect a remaining amount of a paper roll.

Figure 4:
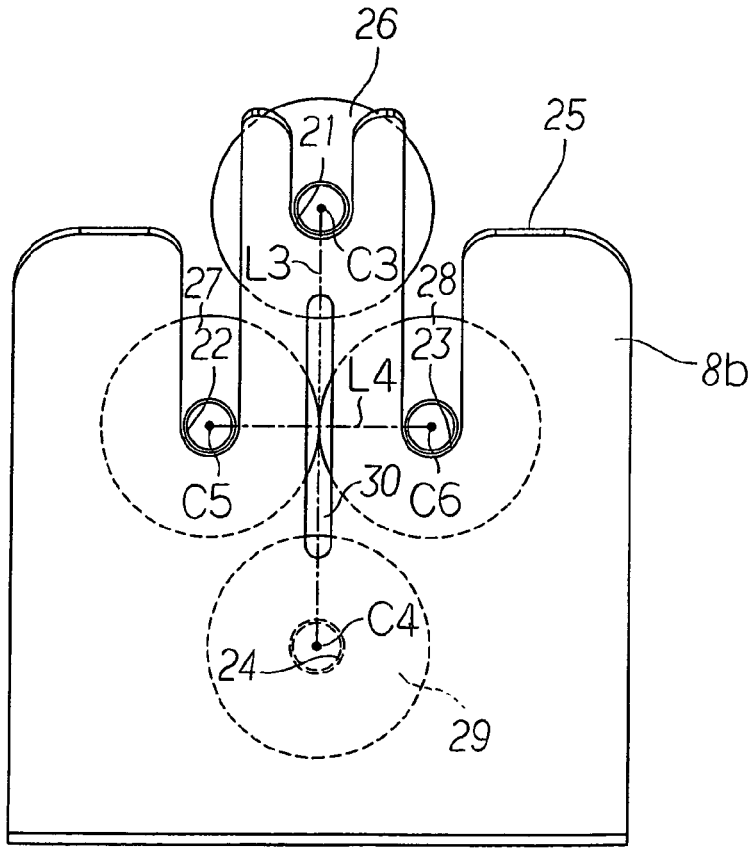
FIG. 4 is an enlarged view of one side plate of a paper feeding device according to another embodiment of the present invention.

Then, as illustrated in FIG. 4, the groove 30 is a long hole which is formed so that a central axis (longitudinal axis) thereof passes through the midpoint of the straight line L4 connecting the central axis (rotation center) C5 of the paper tube 27 and the central axis (rotation center) C6 of the paper tube 28 and is placed on the straight line (vertical bisector) L3 which is vertical to the straight line L4. In other words, the groove 30 is formed so that a distance between the sensor portion 9*b* of the near end sensor 9 and the central axis C5 of the paper tube 27 when the near end sensor 9 is moved closest to the paper tube 27 set in the notch 22 and a distance between the sensor portion 9*b* of the near end sensor 9 and the central axis C6 of the paper tube 28 when the near end sensor 9 is moved closest to the paper tube 28 set in the notch 23 are equal to each other, and that the distance between the sensor portion 9*b* of the near end sensor 9 and the central axis C5 of the paper tube 27 when the near end sensor 9 is moved farthest away from the paper tube 27 set in the notch 22 and the distance between the sensor portion 9*b* of the near end sensor 9 and the central axis C6 of the paper tube 28 when the near end sensor 9 is moved farthest away from the paper tube 28 set in the notch 23 are equal to each other.

Further, the groove 30 is also formed so that the sensor portion 9*b* can detect a near end of a paper roll (not shown) having the paper tube 26 when the near end sensor 9 is slid (positioned) to an end (upper end of FIG. 4) of the groove 30, and can detect a near end of a paper roll (not shown) having the paper tube 29 when the near end sensor 9 is slid (positioned) to another end (lower end of FIG. 4) thereof.

Effects and actions of the paper feeding device provided with the paper holder 25 are the same as those of the paper feeding device according to the embodiment described above. Accordingly, a description thereof is omitted here.

What is claimed is:

1. A paper feeding device that feeds a sheet of a paper roll to a printing device, comprising:

two side plates vertically arranged along both side surfaces of the paper roll;

a plurality of notches formed in each of the side plates, the plurality of notches being capable of bearing-supporting paper rolls having different diameters in an unused state;

a near end sensor for detecting a remaining amount of the paper roll; and a linear groove formed in one of the side plates and in which the near end sensor is slidably disposed to undergo sliding movement in two directions to move close to and away from the paper roll bearing-supported by each of the notches, the groove being formed so that a longitudinal axis of the groove passes through a midpoint of a straight line connecting a rotation center of a paper roll bearing-supported by one notch of the plurality of notches and a rotation center of a paper roll bearing-supported by another notch of the plurality of notches and overlies another straight line which is vertical to the straight line connecting the rotation centers of the paper rolls.

2. A printer comprising the paper feeding device according to claim 1.

3. A paper feeding device for feeding paper from paper rolls having different diameters in an unused state to a printing device, the paper feeding device comprising:

two upstanding side plates spaced apart from one another in opposed relationship, the two side plates having opposed first notches for rotatably bearing-supporting a first paper roll and opposed second notches for rotatably bearing-supporting a second paper roll that may have a different diameter in an unused state from that of the first paper roll; and a near end sensor slidable in a linear groove formed in one of the side plates, the linear groove having a longitudinal axis that passes through a midpoint of a straight line connecting a rotation center of a first paper roll bearing-supported in the first notches and a rotation center of a second paper roll bearing-supported in the second notches, and the near end sensor being slidably positioned along the linear groove to a position to detect a remaining amount of the first and the second paper rolls.

4. A paper feeding device according to claim 3; wherein the first notches are positioned relative to the second notches such that a point on the outer peripheral surfaces of each of the first and second paper rolls in the unused state on a printing device side lie in substantially the same vertical plane.

5. A paper feeding device according to claim 3; wherein the longitudinal axis of the linear groove bisects the straight line connecting the rotation centers.

6. A paper feeding device according to claim 5; wherein the first notches are at a height different from that of the second notches so that the straight line connecting the rotation centers is not a horizontal line.

7. A paper feeding device according to claim 5; wherein the first and second notches are at the same height so that the straight line connecting the rotation centers is a horizontal line.

8. A printer having the paper feeding device according to claim 7.

9. A printer having the paper feeding device according to claim 5.

10. A paper feeding device according to claim 3; wherein the two side plates have opposed third notches for rotatably bearing supporting a third paper roll, the longitudinal axis of the linear groove lying along a line that intersects a rotation center of the third paper roll so that the near end sensor can be slidably positioned along the linear groove to detect a remaining amount of the third paper roll.

11. A printer having the paper feeding device according to claim 3.

* * * * *